US012336622B2

(12) United States Patent
Henry

(10) Patent No.: US 12,336,622 B2
(45) Date of Patent: Jun. 24, 2025

(54) BELT CLIP

(71) Applicant: Andrew Henry, Bloomington, IN (US)

(72) Inventor: Andrew Henry, Bloomington, IN (US)

(73) Assignee: Henry Holsters LLC, Spencer, IN (US)

( * ) Notice: Subject to any disclaimer, the term of this patent is extended or adjusted under 35 U.S.C. 154(b) by 166 days.

(21) Appl. No.: 18/242,941

(22) Filed: Sep. 6, 2023

(65) Prior Publication Data

US 2024/0074567 A1 Mar. 7, 2024

Related U.S. Application Data

(60) Provisional application No. 63/403,966, filed on Sep. 6, 2022.

(51) Int. Cl.
*A45F 5/02* (2006.01)

(52) U.S. Cl.
CPC ..... *A45F 5/021* (2013.01)

(58) Field of Classification Search
CPC ..... A45F 5/021; A45F 5/1516
USPC ..... 224/667
See application file for complete search history.

(56) References Cited

U.S. PATENT DOCUMENTS

| | | | | |
|---|---|---|---|---|
| 5,265,781 | A * | 11/1993 | Nichols | F41C 33/0227 224/198 |
| 5,419,472 | A * | 5/1995 | Hellweg | A45F 5/02 224/198 |
| 6,145,169 | A | 11/2000 | Terzuol et al. | |
| 6,349,904 | B1 | 2/2002 | Polad | |
| 6,823,566 | B2 | 11/2004 | Coffey | |
| 7,389,899 | B2 * | 6/2008 | Johnson | A45F 5/02 224/675 |
| 8,458,867 | B2 | 6/2013 | Rogers | |
| 9,134,544 | B2 * | 9/2015 | Rochford | G02C 5/2272 |
| 9,504,309 | B2 * | 11/2016 | Ralph | A45F 5/00 |
| 10,130,162 | B2 | 11/2018 | Tang | |
| 2007/0090138 | A1 * | 4/2007 | Parsons | A45F 5/02 224/666 |

* cited by examiner

*Primary Examiner* — Adam J Waggenspack
(74) *Attorney, Agent, or Firm* — Asgaard Patent Services, LLC; F. Wayne Thompson, Jr.

(57) ABSTRACT

Disclosed are implementation of a belt clip used to attach a carrier, such as a light holster, to a belt and maintain its position on the belt. The belt clip is configured to fold over upon itself so that at least one fastener can be used to removably secure overlapped ends of the belt clip together, thereby forming a closed loop adapted to receive the belt.

12 Claims, 3 Drawing Sheets

BELT CLIP

CROSS-REFERENCE TO RELATED APPLICATION(S)

This application claims the benefit of U.S. Provisional Application Ser. No. 63/403,966, filed on Sep. 6, 2022, the entirety of which is incorporated herein by reference.

TECHNICAL FIELD

This disclosure relates to implementations of a belt clip, and specifically to a belt clip used to attach a carrier, such as a holster or sheath, to a belt.

BACKGROUND

Belts clips are used by warfighters, law enforcement officers and armed civilians to securely attach gear to their belts for daily carry, and to position the gear so that it is within easy reach. Certain items of gear, such as holsters, magazine carriers, and flashlight carriers, are often positioned to facilitate rapid deployment when needed. Belt clips also allow end users to position gear so that weight is evenly distributed about their waste, thereby eliminating, or at least minimizing, any hindrance to movement and discomfort during extended wear. Additionally, some belt clips allow end users to position gear, such as a magazine pouch, at an angle optimal for the rapid deployment and use of the item carried by the gear.

Accordingly, needs exist for the belt clip disclosed herein. It is to the provision of a belt clip configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed are implementations of a belt clip used to attach a carrier, such as a light holster, to a belt and maintain its position on the belt. The belt clip is configured to fold over upon itself so that at least one fastener can be used to removably secure overlapped ends of the belt clip together, thereby forming a closed loop adapted to receive the belt.

An example belt clip comprises: a first section that includes at least one hole positioned near a first end of the belt clip; a second section that includes at least one hole positioned near a second end of the belt clip; a middle portion positioned between the first section and the second section; and, at least one fastener. The at least one fastener comprising a threaded post, a screw, and a spacer. The belt clip is configured to fold over upon itself and the at least one fastener used to removably secure overlapped ends of the belt clip together, thereby forming a closed loop adapted to receive the belt. The at least one hole in the first section and the second section are positioned to align with each other when the belt clip is folded over upon itself. The spacer of the at least one fastener is positioned between the overlapped ends of the belt clip, and configured to expand and contact an edge of the belt when compressed by the overlapped ends of the belt clip.

Another example belt clip comprises: a first section that includes at least one hole positioned near a first end of the belt clip; a second section that includes at least one hole positioned near a second end of the belt clip; a middle portion positioned between the first section and the second section; and, at least one fastener. The at least one fastener comprising a threaded post, a screw, and a spacer. The belt clip is configured to fold over upon itself and the at least one fastener used to removably secure overlapped ends of the belt clip together, thereby forming a closed loop adapted to receive the belt. The at least one hole in the first section and the second section are positioned to align with each other when the belt clip is folded over upon itself. The spacer of the at least one fastener is positioned between the overlapped ends of the belt clip, and configured to expand and contact an edge of the belt when compressed by the overlapped ends of the belt clip. Expansion of the spacer causes another edge of the belt to contact the middle portion of the belt clip, and causes the belt clip to conform to the belt.

BRIEF DESCRIPTION OF THE DRAWINGS

Like reference numerals refer to corresponding parts throughout the several views of the drawings.

DETAILED DESCRIPTION

Figure 1:
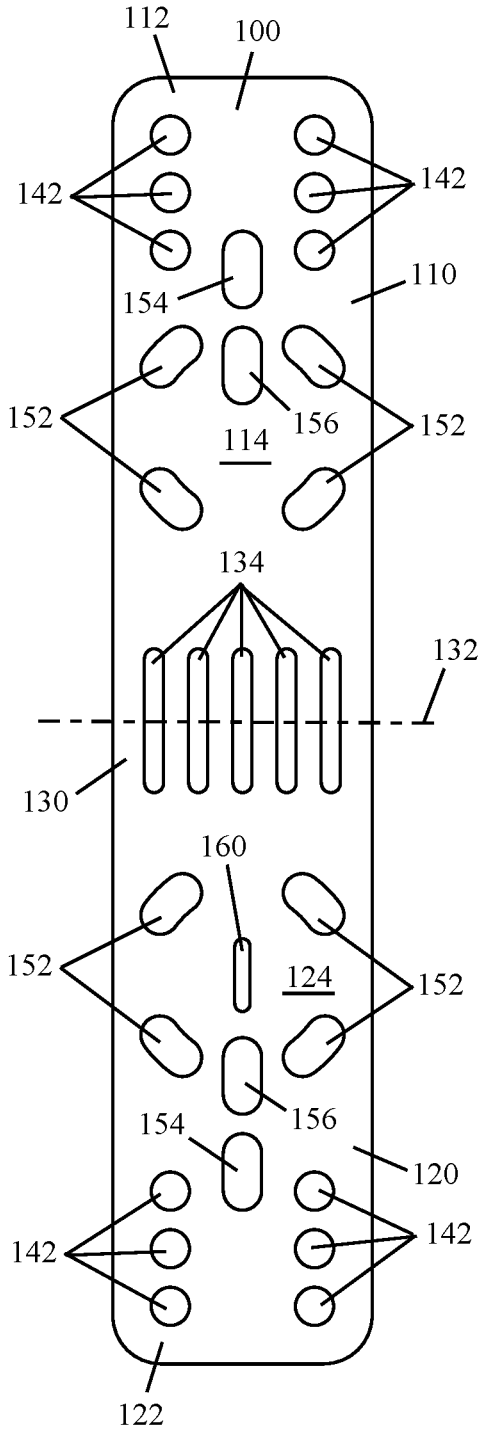
FIG. 1 is a top plan view of a belt clip according to the principles of the present disclosure.
Figure 2:
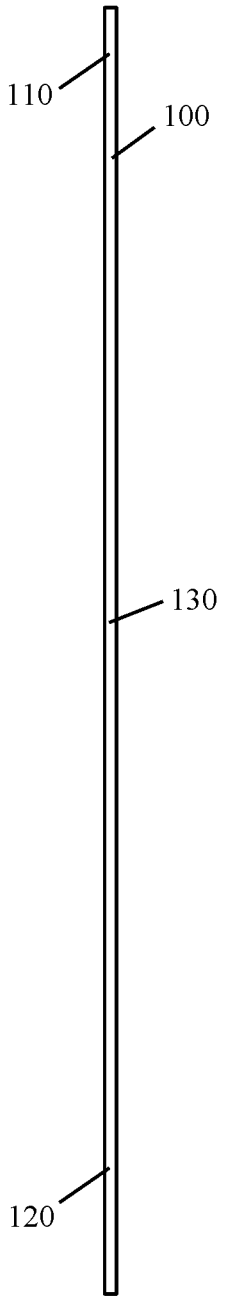
FIG. 2 is a side elevational view of the belt clip shown in FIG. 1.
Figure 5:
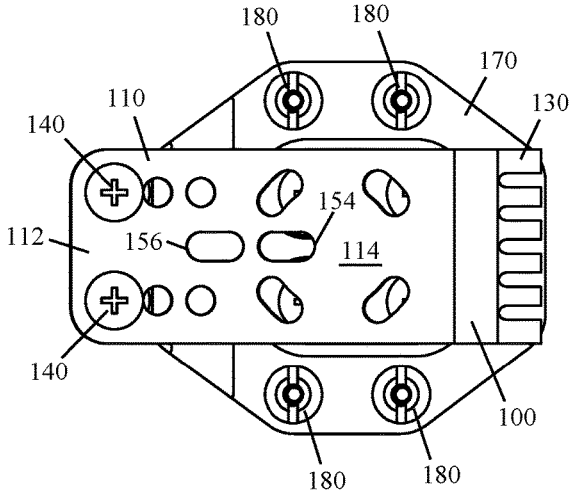
FIGS. 3-6 illustrate a light holster equipped with the belt clip shown in FIGS. 1 and 2; the belt clip is shown folded over upon itself with the ends secured together by a pair of fasteners to form a closed loop.
Figure 6:
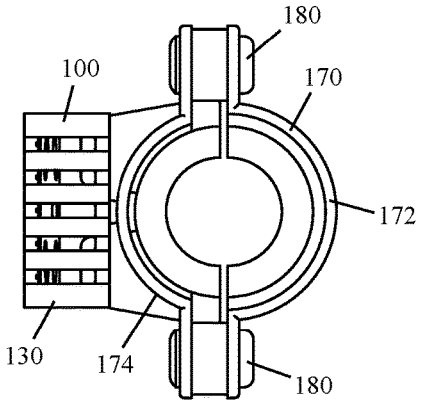

FIGS. 1 and 2 illustrate a belt clip 100 according to the principles of the present disclosure. FIGS. 3-6 illustrate an example light holster 170 equipped with the belt clip 100 shown in FIGS. 1 and 2. The belt clip 100 can be used to attach a carrier, such as the light holster 170, to a belt and maintain its position on the belt. The belt clip 100 also provides for cant adjustment of the attached carrier.

As shown in FIG. 1, the belt clip 100 comprises two sections 110, 120 separated by a middle portion 130. The belt clip 100 is constructed as one piece, and is fabricated from a polypropylene composite material that is flexible and stiff (e.g., Tegris® thermoplastic composite fabric). However, other thermoplastic polymer materials resistant to flex failure and stress cracking, while maintaining high stiffness, could be used. In some implementations, the belt clip 100 is 0.9 mm-1.6 mm thick.

Figure 4:
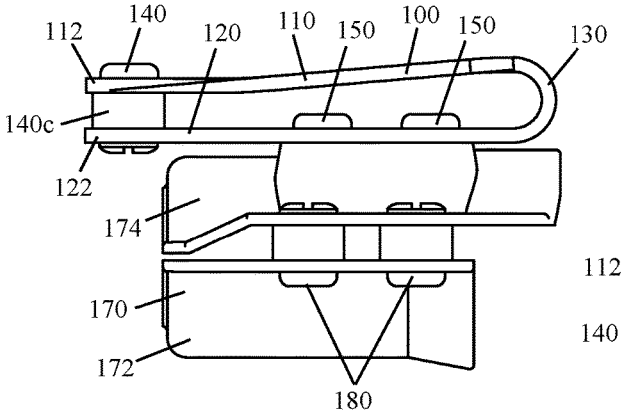
Figure 3:
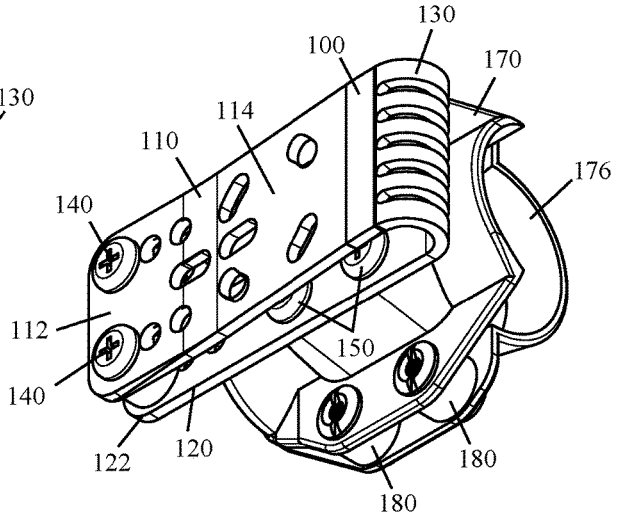

As shown in FIGS. 3 and 4, the belt clip 100 can be formed into a closed loop used to attach a carrier, such as the light holster 170, to a belt. More specifically, the belt clip 100 is configured to fold over upon itself so that a pair of fasteners 140 can be used to removably secure overlapped ends (112, 122) of the belt clip 100 together, thereby forming a closed loop adapted to receive a belt. Each example fastener 140 comprising a threaded post 140*a*, a screw 140*b*, and a spacer 140*c*.

Each section (110, 120) of the belt clip 100 includes two horizontally spaced holes 142 positioned near an end (112, 122) of the belt clip 100. The holes 142 in each section (110, 120) of the belt clip 100 are positioned to align with corresponding holes 142 in the opposing section (110, 120) of the belt clip 100 when the belt clip 100 is folded over upon itself. In this way, a fastener 140 can be passed through each pair of aligned holes 142 (see, e.g., FIGS. 3 and 4).

A shown in FIG. 4, the spacer 140*c* of each fastener 140 is positioned between the two sections (110, 120) of the belt clip 100. Each spacer 140*c* is made out of a flexible and/or compressible material. Tightening the screw 140*b* of each fastener 140 causes the two sections (110, 120) of the belt clip 100 to compress the spacer 140*c*, thereby causing it to expand (i.e., increase in diameter) and make contact with the bottom edge of a belt. Expansion of the spacer 140*c* causes the top edge of the belt to make contact with the middle portion 130 of the belt clip 100, and causes the belt clip 100 to conform to the belt, thereby increasing the surface area in contact between the belt clip 100 and the belt on the inner belt surface, outer belt surface, and top belt surface. Succinctly put, the expansion of the spacer 140*c* results in contact between the belt clip 100 and all four sides of the belt. In this way, the belt clip 100 is configured to resist unwanted movement on the belt and thereby maintain the position of an attached carrier.

As shown in FIG. 1, each section (110, 120) of the belt clip 100 can be configured to include as many as six holes 142 arranged to form an array of three rows and two columns. In this way, the belt clip 100 is configured to form three differently sized closed loops suitable for wrapping about three differently size belts, for example, 2.0" wide, 2.25" wide, and 2.5" wide duty belts. Belt width compatibility being dependent on the thickness of the belt.

As shown in FIG. 1, each section (110, 120) of the belt clip 100 includes an attachment interface (114, 124) configured so that a carrier, such as the light holster 170, can be affixed thereto. Each attachment interface (114, 124) is a hole pattern comprising an array of spaced openings 152, preferably in the form of arcuate slots. A combination of openings 152 can be used in conjunction with fasteners 150 to affix the light holster 170, or other suitably configured carrier, to the belt clip 100 (see, e.g., FIG. 3). The light holster 170 can even be attached to the arcuate slots 152 at various angular relationships, well known to those of ordinary skill in the art. In this way, the belt clip 100 provides for cant adjustment of the attached carrier (e.g., the light holster 170).

As shown in FIG. 1, in some implementations, each attachment interface (114, 124) may include an additional opening 154, preferably in the form of an elongate slot, that is offset from the arcuate slots 152 of the hole pattern. This elongate slot 154 in conjunction with two arcuate slots 152, of the same attachment interface, can be used to attach a suitably configured carrier such that it has no cant. In the illustrated example, this combination of openings enables attachment of Safariland® equipment locking system (ELS) compatible carriers to the belt clip 100. While the attachment interfaces (114, 124) of the example belt clip 100 are compatible with Safariland® ELS compatible carriers and the light holster 170 disclosed herein, it should be understood that the attachment interfaces (114, 124) could be configured for compatibility with carriers configured to interface with other hole patterns.

The openings 154 can also be used to secure the belt clip 100 to a smaller belt, for example, a 1.5"-1.75" wide belt. Belt width compatibility being dependent on the thickness of the belt. The opening 154 of each attachment interface (114, 124) is positioned to align with the opening 154 in the opposing attachment interface (114, 124) of the belt clip 100 when the belt clip 100 is folded over upon itself (see, e.g., FIG. 5). A fastener (e.g., fastener 140) can be passed through the aligned pair of openings 154 and used to form the belt clip 100 into a closed loop (not shown).

As shown in FIG. 1. in some implementation, each attachment interface (114, 124) includes yet another additional opening 156, preferably in the form of an elongate slot, that is positioned between two of the accurate slots 152 of the hole pattern. These openings 156 can also be used to secure the belt clip 100 to a belt, for example, a 1.25"-1.5" wide belt. Again, the opening 156 of each attachment interface (114, 124) is positioned to align with the opening 156 in the opposing attachment interface (114, 124) of the belt clip 100 when the belt clip 100 is folded over upon itself (see, e.g., FIG. 5). A fastener (e.g., fastener 140) can be passed through the aligned pair of openings 156 and used to form the belt clip 100 into a closed loop (not shown).

The belt clip 100 is reversable, with an attachment interface (114, 124) on the inner and outer portion of the folded belt clip 100, and also configured so that a user can change the ride height of an attached carrier. As used herein, "ride height" is the position of an attached carrier in relation to a belt. Each attachment interface (114, 124) of the belt clip 100 is configured to provide for a different ride height. In particular, the attachment interface 114 on the first section 110 of the belt clip 100 provides for a "low" ride height relative to the attachment interface 124 on the second section 120 of the belt clip 100, which provides for a "high" ride height. Also, when the attached carrier is secured to the attachment interface 114 on the first section 110 of the belt clip 100, the attachment interface 124 on the second section 120 is oriented toward the inside face of the belt; when the attached carrier is secured to the attachment interface 124 on the second section 120 of the belt clip 100, the attachment interface 114 of the first section 110 is oriented toward the inside face of the belt.

To aid the user in affixing a carrier to the attachment interface (114, 124) corresponding with a desired ride height, the belt clip 100 may be provided with an indicium 160. The example indicium 160 is a longitudinal slit in the second section 120 that is positioned between the arcuate slots 152 of the hole pattern, though the indicium 160 could be positioned elsewhere on the belt clip 100. The illustrated indicium 160 is provided as a nonlimiting example only. It should be understood that any other suitable indicium could be used.

As shown in FIGS. 3-7, in use, the belt clip 100 is folded primarily at the middle portion 130, about fold line 132. The middle portion 130 of the belt clip 100 is a living hinge. The living hinges comprises multiple elongate slots 134 in the material to aid the middle portion 130 in folding more easily. In some implementations, each hinge slot 134 is a longitudinally extending elongate slot. However, in other implementations, each hinge slot 134 could be oriented diagonally or laterally relative to the fold line 132 shown in FIG. 1. In the illustrated example, there are five hinge slots 134.

Figure 7:
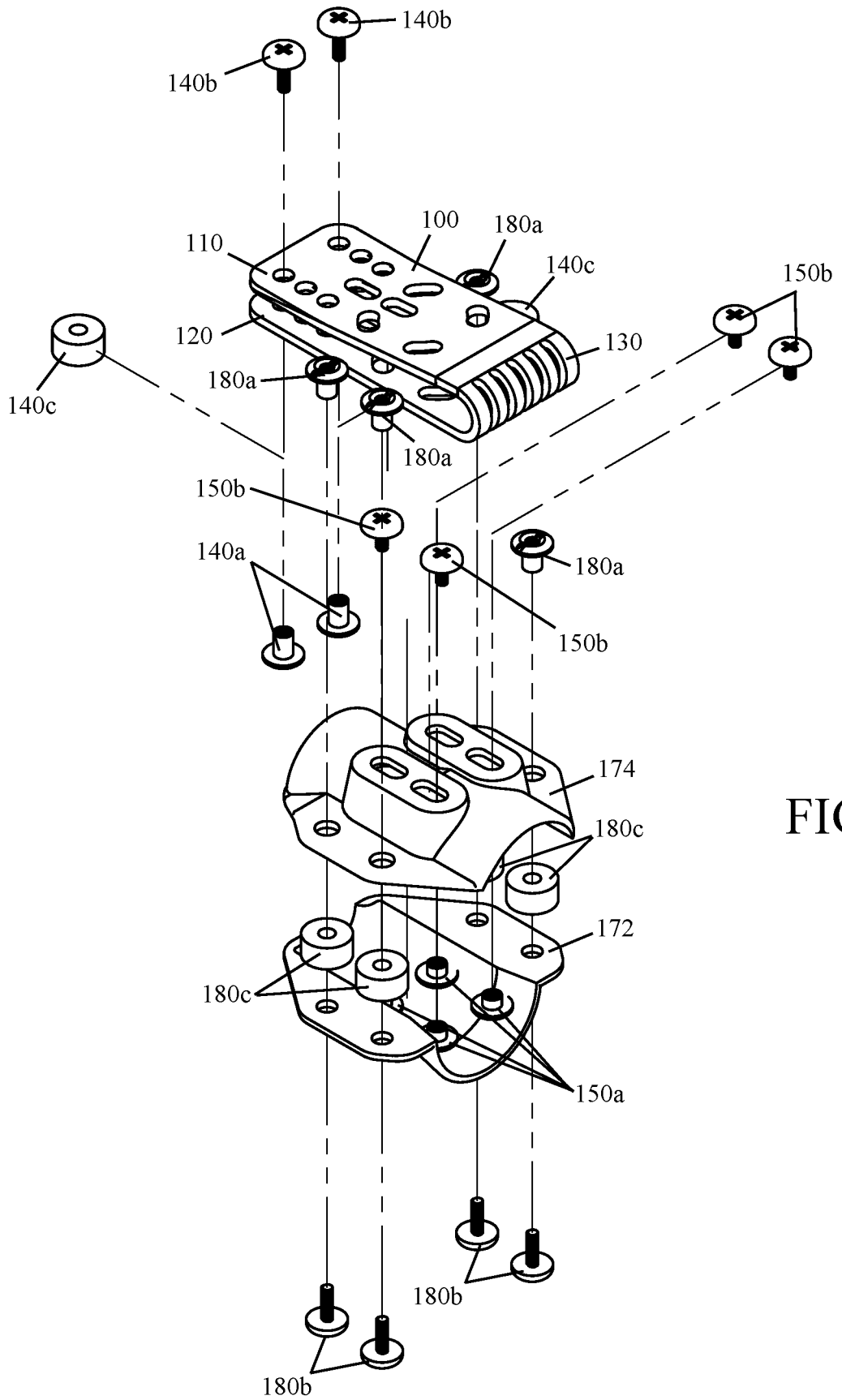
FIG. 7 illustrates an exploded view of the light holster and belt clip shown in FIGS. 3-6.

As shown best in FIG. 7, the light holster 170 comprises a front shell 172 and a back shell 174 interconnected to form a compartment 176 suitable for carrying a handheld light. In particular, the compartment 176 is configured to receive the head of a handheld light. The front shell 172 and back shell 174 are held together by fasteners 180. Each example fastener 180 comprising a threaded post 180*a*, a screw 180*b*, and a spacer 180*c*.

As shown in FIGS. 3 and 4, the light holster 170 is attached to the belt clip 100 by fasteners 150 that secure the back shell 174 to the attachment interface 124 on the second section 120 of the belt clip 100. It should be understood that the same fasteners 150 could be used to attach the light holster 170 to the attachment interface 114 on first section 110 of the belt clip 100. The light holster 170 being attached to one of either the first section 110 or the second section 120 of the belt clip 100 depending on the desired ride height. An example fastener 150 comprises a threaded post 150*a* and a screw 150*b*.

While the example carrier is configured to receive and retain a handheld light (not shown), the light holster 170 disclosed herein is provided as a nonlimiting example only. Therefore, it should be understood that another carrier, for a handheld light or a different item (e.g., a pistol magazine), configured for attachment to the attachment interfaces (114, 124) could be affixed to the belt clip 100.

One or more implementations of the belt clip 100 could be adapted and used to attach a carrier to webbing, such as PALS webbing.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A belt clip used to attach an article to a belt and maintain its position on the belt, the belt clip comprising:

a first section that includes at least one hole positioned near a first end of the belt clip;

a second section that includes at least one hole positioned near a second end of the belt clip;

a middle portion positioned between the first section and the second section; and, at least one fastener, the at least one fastener comprising a threaded post, a screw, and a spacer;

wherein:

the belt clip is configured to fold over upon itself and the at least one fastener used to removably secure overlapped ends of the belt clip together, thereby forming a closed loop adapted to receive the belt;

the at least one hole in the first section and the second section are positioned to align with each other when the belt clip is folded over upon itself; and, the spacer of the at least one fastener is positioned between the overlapped ends of the belt clip, and configured to expand and contact an edge of the belt when compressed by the overlapped ends of the belt clip.

2. The belt clip of claim 1, wherein at least one of the first section and the second section of the belt clip include an attachment interface configured so that a carrier can be affixed thereto.

3. The belt clip of claim 1, wherein the first section, the second section, and the middle portion are a single unitary piece of flexible and stiff material.

4. The belt clip of claim 3, wherein the single unitary piece of flexible and stiff material is a thermoplastic composite fabric.

5. The belt clip of claim 1, wherein the belt clip is foldable at the middle portion.

6. The belt clip of claim 5, wherein the middle portion is a living hinge comprising multiple elongate slots.

7. A belt clip used to attach an article to a belt and maintain its position on the belt, the belt clip comprising:

a first section that includes at least one hole positioned near a first end of the belt clip;

a second section that includes at least one hole positioned near a second end of the belt clip;

a middle portion positioned between the first section and the second section;

and, at least one fastener, the at least one fastener comprising a threaded post, a screw, and a spacer;

wherein:

the belt clip is configured to fold over upon itself and the at least one fastener used to removably secure overlapped ends of the belt clip together, thereby forming a closed loop adapted to receive the belt;

the at least one hole in the first section and the second section are positioned to align with each other when the belt clip is folded over upon itself;

the spacer of the at least one fastener is positioned between the overlapped ends of the belt clip, and configured to expand and contact an edge of the belt when compressed by the overlapped ends of the belt clip; and, expansion of the spacer causes another edge of the belt to contact the middle portion of the belt clip, and causes the belt clip to conform to the belt.

8. The belt clip of claim 7, wherein at least one of the first section and the second section of the belt clip include an attachment interface configured so that a carrier can be affixed thereto.

9. The belt clip of claim 7, wherein the first section, the second section, and the middle portion are a single unitary piece of flexible and stiff material.

10. The belt clip of claim 9, wherein the single unitary piece of flexible and stiff material is a thermoplastic composite fabric.

11. The belt clip of claim 7, wherein the belt clip is foldable at the middle portion.

12. The belt clip of claim 11, wherein the middle portion is a living hinge comprising multiple elongate slots.

* * * * *